US007735943B2

(12) United States Patent
Hottmann

(10) Patent No.: US 7,735,943 B2
(45) Date of Patent: Jun. 15, 2010

(54) HINGED ACCESS PANEL FOR REFRIGERATED APPLIANCE

(75) Inventor: Philip F. Hottmann, Madison, WI (US)

(73) Assignee: Sub-Zero, Inc., Madison, WI (US)

( * ) Notice: Subject to any disclaimer, the term of this patent is extended or adjusted under 35 U.S.C. 154(b) by 695 days.

(21) Appl. No.: 11/654,339

(22) Filed: Jan. 17, 2007

(65) Prior Publication Data

US 2008/0168793 A1 Jul. 17, 2008

(51) Int. Cl.
*A47B 96/04* (2006.01)

(52) U.S. Cl. ..... 312/401; 312/327

(58) Field of Classification Search ..... 16/286, 16/287, 288, 366; 312/325, 323, 322, 327, 312/328, 405, 198, 116, 319.2; 49/152, 153, 49/246, 248; 62/452, 440
See application file for complete search history.

(56) References Cited

U.S. PATENT DOCUMENTS 2,674,761 A * 4/1954 Weiss ..... 16/288
3,351,975 A * 11/1967 Koji ..... 16/288
4,050,116 A * 9/1977 Salice ..... 16/288
4,736,491 A * 4/1988 Mertes ..... 16/358
4,854,010 A * 8/1989 Maraghe et al. ..... 16/360
4,867,512 A * 9/1989 Wilkins et al. ..... 312/245
4,955,569 A 9/1990 Hottmann
5,027,473 A 7/1991 Hottmann
5,035,026 A * 7/1991 Carlo et al. ..... 16/288
5,040,857 A 8/1991 Mandel et al.
5,158,503 A 10/1992 Mitchell
5,497,534 A 3/1996 Caruso
5,497,634 A 3/1996 Kojima et al.
5,896,619 A 4/1999 Koopman
5,931,554 A 8/1999 Koopman
5,971,514 A * 10/1999 Hayakawa ..... 312/319.2
6,374,459 B1 * 4/2002 Zetti ..... 16/366
6,402,472 B1 * 6/2002 Hogue et al. ..... 416/132 A
6,568,035 B2 * 5/2003 Zetti ..... 16/370
6,845,545 B2 1/2005 Han et al.
6,883,579 B2 * 4/2005 Olmsted ..... 160/189
7,543,356 B2 * 6/2009 Zetti ..... 16/288
2004/0189164 A1 * 9/2004 Hwang ..... 312/405
2004/0237257 A1 12/2004 Pohl
2005/0132535 A1 6/2005 Jang et al.
2005/0218766 A1 * 10/2005 Hwang ..... 312/405

(Continued)

OTHER PUBLICATIONS

Sub-Zero Design Guide, 3758546 Rev-B, Sep. 2006, 84 pages.

(Continued)

*Primary Examiner*—Darnell M Jayne
*Assistant Examiner*—Andres Gallego
(74) *Attorney, Agent, or Firm*—Foley & Lardner LLP

(57) ABSTRACT

A refrigerated appliance with a hinged access panel is disclosed. The refrigerated appliance comprises a frame, the panel, and one or more hinges coupling the panel to the frame. Each hinge has a linkage that guides the movement of the panel between a closed position and an open position. The movement of the linkage has a linear component and a rotational component. The refrigerated appliance may include a latch configured to retain the panel in the open position. The refrigerated appliance may include one or more biasing elements configured to bias the panel toward the open position.

14 Claims, 4 Drawing Sheets

U.S. PATENT DOCUMENTS

| | | | | |
|---|---|---|---|---|
| 2005/0273974 | A1 | 12/2005 | Han | |
| 2006/0232176 | A1 | 10/2006 | Kim et al. | |
| 2006/0244351 | A1 | 11/2006 | Moon et al. | |
| 2008/0036348 | A1 * | 2/2008 | Carden et al. | 312/401 |

OTHER PUBLICATIONS

Sub-Zero Freezer Company, Inc., PRO 48 Use & Care Information, p. 11, Apr. 2005.

* cited by examiner

HINGED ACCESS PANEL FOR REFRIGERATED APPLIANCE

BACKGROUND

The present invention relates to an access door or panel for a refrigerated appliance. More specifically, the present invention relates to an access panel hingedly coupled to a refrigerated appliance.

Refrigerated appliances having one or more refrigerator compartments and/or freezer compartments are generally known. It is generally known to provide such refrigerated appliances with a removable panel to provide access to mechanical or electrical components that control or operate the refrigerator (e.g., for maintenance, repair, installation, cleaning, etc.). However, access panels are typically mounted with fasteners (e.g., bolts, snaps, etc.) that may be (undesirably) visible or difficult to access or remove/operate. Also, when used on larger refrigeration systems (particularly those that also have a decorative panel), the access panel is typically heavy, which makes its support or attachment susceptible to fatigue and unwieldy when being removed and reattached. Further, in instances were a hinge is provided to combination or integrated refrigerated appliances, the hinge only provides for pivoting or rotation of the panel about a single axis, which requires an undesirable amount of clearance between the panel and its environment in some installations.

Accordingly, it would be advantageous to provide a hinged access panel for a refrigerated appliance that allows multiple axis/plane/direction movement of the access panel. It would also be advantageous to provide a hinged access panel that is retained in the open position when desired and/or biased to the open position to assist opening. It would further be advantageous to provide an access panel with a hinge linkage that allows both pivoting and translational movement to allow clearance with its adjacent environment. It would be desirable to provide for an access panel hinge for refrigerator having one or more of these or other advantageous features. To provide an inexpensive, reliable, and widely adaptable access panel that avoids the above-referenced and other problems would represent a significant advance in the art.

SUMMARY

One embodiment of the present invention relates to a refrigerated appliance comprising a frame; a panel extending substantially the width of the frame; and a first hinge coupling the panel to the frame and having a linkage system that guides movement of the panel between a closed position and an open position. The movement of the linkage system has a linear component and a rotational component.

Another embodiment of the present invention relates to a refrigerated appliance comprising a frame; a panel extending substantially the width of the frame and moveable between a closed position and an open position; one or more hinges having a linkage with a plurality of members coupling the panel to the frame; and a latch coupled to the linkage and configured to retain the panel in the open position when engaged.

Another embodiment of the present invention relates to a closure mechanism (e.g., a kit) for a refrigerated appliance having a first refrigeration unit and a second refrigeration unit distinct from the first refrigeration unit and located laterally adjacent to the first refrigeration unit. The closure mechanism comprises a frame configured to couple the first refrigeration unit to the second refrigeration unit; a panel configured to extend between outside lateral edges of the first refrigeration unit and the second refrigeration unit; and a pair of hinges configured to couple the panel to the frame, each hinge having a linkage. The linkage is configured to provided the panel with guided lateral and rotational movements between a closed position and an open position.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1A:
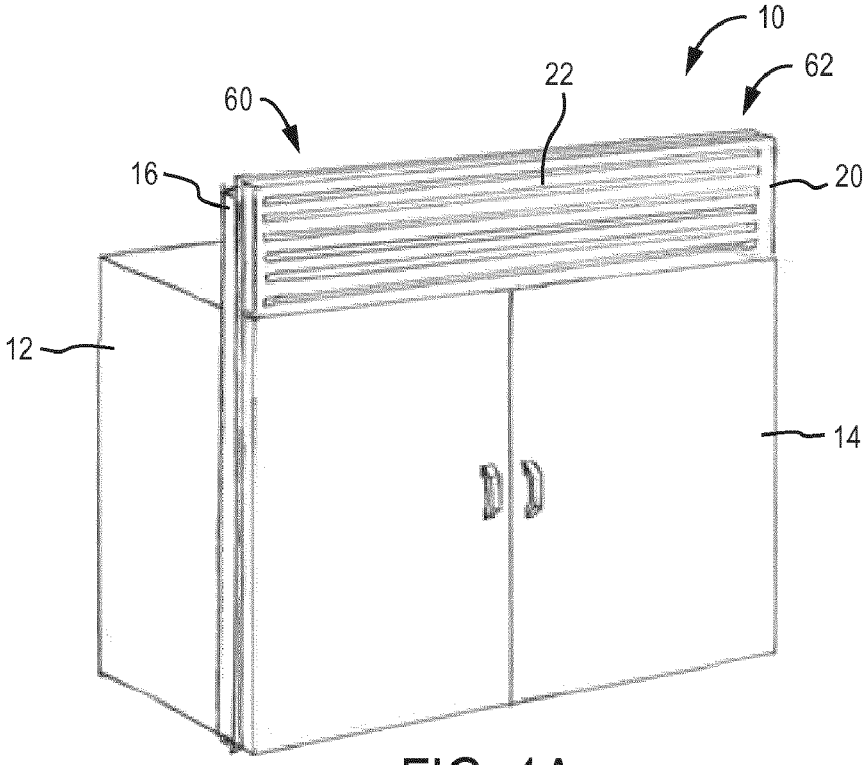
FIGS. 1A-1B are perspective views of a refrigerator unit with a panel coupled to two hinges according to a preferred an exemplary embodiment showing the panel in an open and a closed position.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF THE PREFERRED AND EXEMPLARY EMBODIMENTS

Figure 1B:
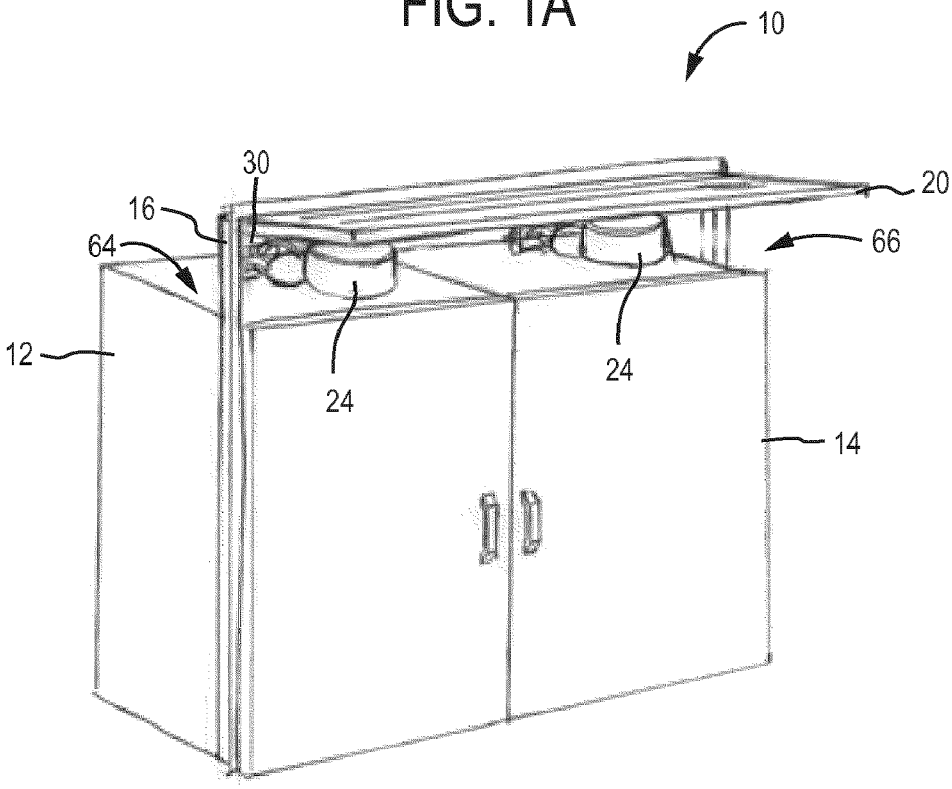
Figure 2:
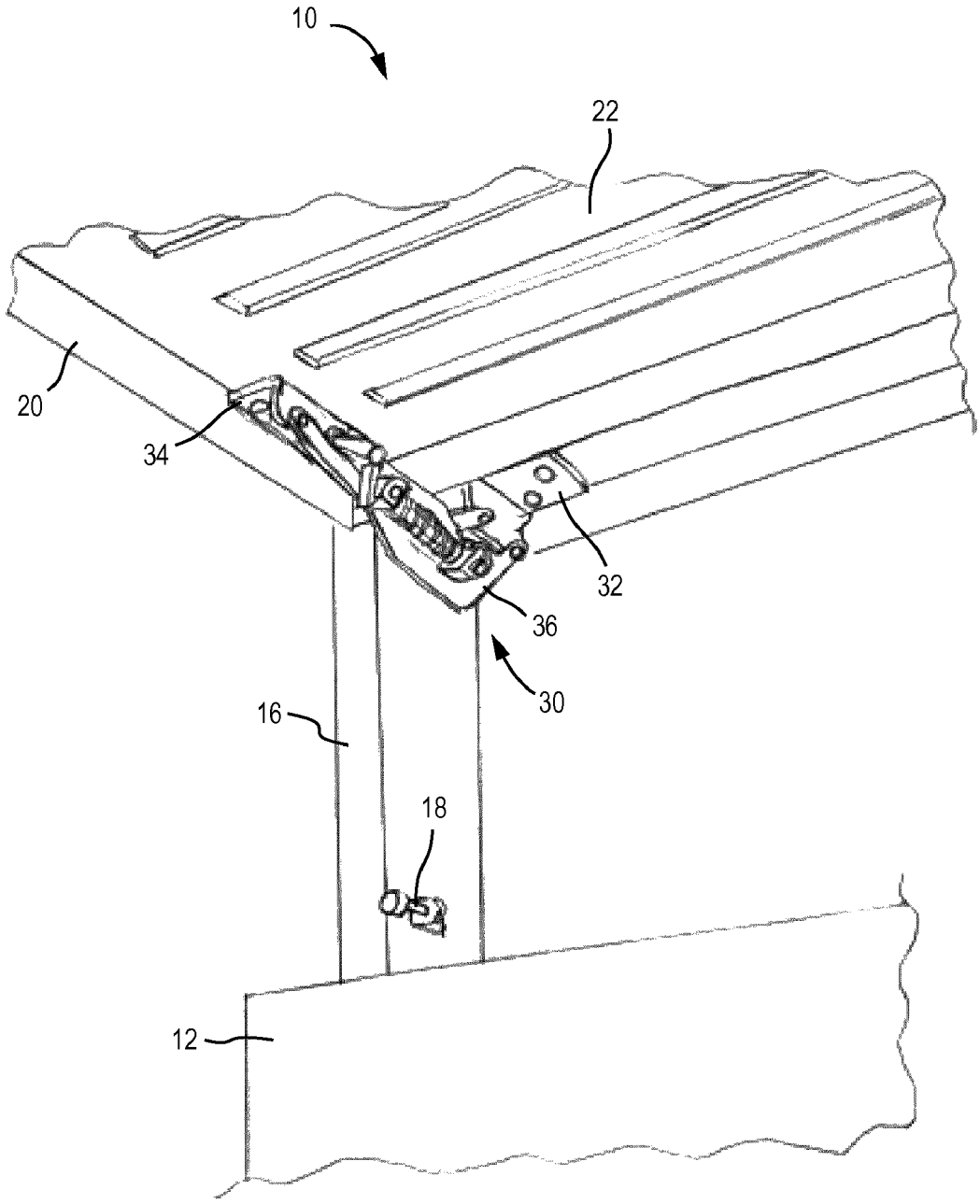
FIG. 2 is a close-up perspective view of a portion of the refrigerator unit in FIGS. 1A-1B showing one of the hinges in greater detail according to a preferred an exemplary embodiment.
Figure 3:
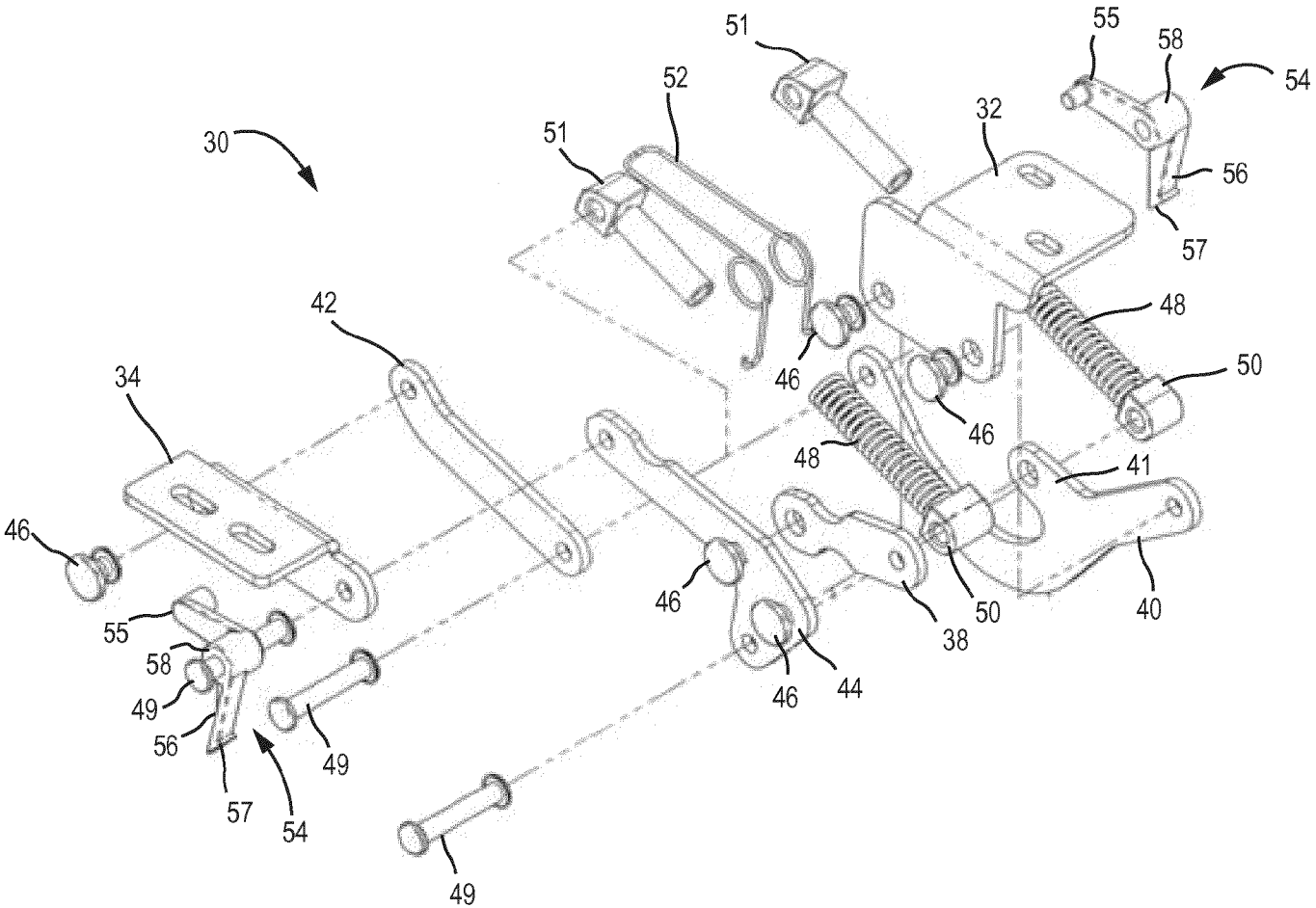
FIG. 3 is an exploded view of the hinge in FIG. 2 according to a preferred an exemplary embodiment.

FIGS. 1A and 1B show a refrigerated appliance 10 according to a preferred embodiment. Refrigerated appliance 10 includes a first refrigeration unit 12, a second refrigeration unit 14, a frame 16, a panel 20, and hinges 30. Panel 20 is operatively coupled at a first end 60 and a second end 62 to frame 16 by hinges 30 and is configured to move (e.g., pivot, rotate, swing, swivel, slide, etc.) between a first or closed position and a second or open position to provide visual and/or physical access above first and second refrigeration units 12, 14.

Refrigeration units 12 and 14 have doors that allow access to an interior refrigerated space. According to an exemplary embodiment, first and second refrigeration units 12, 14 are distinct or separate appliances that operate independently from each other. Units 12, 14 are arranged laterally adjacent each other to provide a desired refrigeration capacity. By being adjacent, units 12, 14 also provide a desired appearance (e.g., large integrated refrigeration). Units 12, 14 may be a pair of refrigerators, a pair of freezers, or one refrigerator and one freezer. Refrigerated appliance 10 may also have a variety of configurations, such as an integrated combination refrigerated appliance (i.e., having cooled storage for fresh foods and freezer storage for frozen foods) that are side-by-side, over-under, under-counter, drawers, icemakers, wine storage, or the like. Refrigeration units 12 and 14 further include components 24 of a refrigeration system or circuit (e.g., compressor, condenser, controller, etc.) that cools the interior space and may be located on the top of refrigeration units 12 and 14 (e.g., above the cabinet or enclosure that forms/defines the cooled space). According to an exemplary embodiment, first and second refrigeration units 12, 14 are adjacent to each other and are coupled together with frame 16.

Frame 16 is intended to align and secure units 12, 14 and provide a structure for securing panel 20. Frame 16 is a generally rigid body that is coupled to an outer lateral side 64 of first refrigeration unit 12 and an outer lateral side 66 of second refrigeration unit 14 and extends above the top of refrigeration units 12 and 14.

Panel 20 is provided above refrigeration units 12, and 24 extends substantially the width of refrigeration units 12 and 14 to at least partially conceal components 24 to provide a continuous or integrated appearance to separate, adjacent (side by side) refrigeration units. According to an exemplary embodiment, panel 20 is a grate or grill with a plurality of slats 22 that allow air to pass through panel 20 (e.g., to pass over and cool components 24). Panel 20 is coupled to frame 16 with hinges 30 and is moveable from a first or closed position (shown in FIG. 1A as substantially vertical) and a second or open position (shown in FIG. 1B as substantially horizontal) in which it provides visible and physical access to components 24. Frame 16 includes features shown as adjustable stoppers 18 that provide a surface for panel 20 to contact when it is returned to the closed position so it does not contact frame 16. According to an exemplary embodiment, refrigeration units 12 and 14 are separate units and panel 20 helps to create the appearance of a single unit. According to another exemplary embodiment, refrigerated appliance 10 may include a single refrigeration unit. The panel may also function as a support structure for one or more decorative elements or panels (e.g., metal, wood, plastic, etc.) that may be used to match with other decorative elements in its environment.

Figure 4:
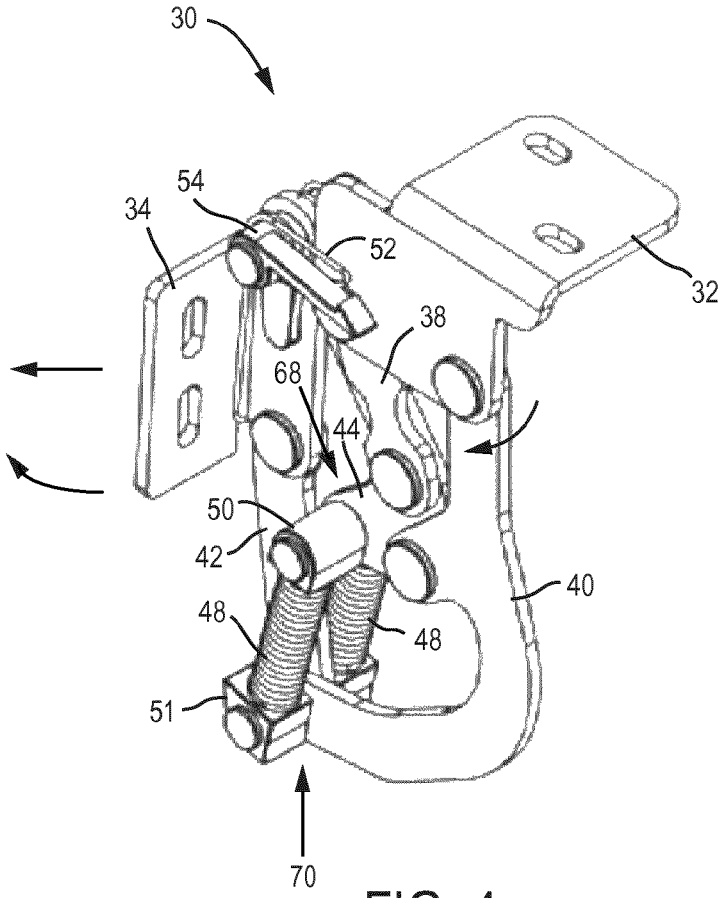
FIG. 4 is an isometric view of the hinge in FIG. 2 in a first or closed position according to a preferred an exemplary embodiment.
Figure 5:
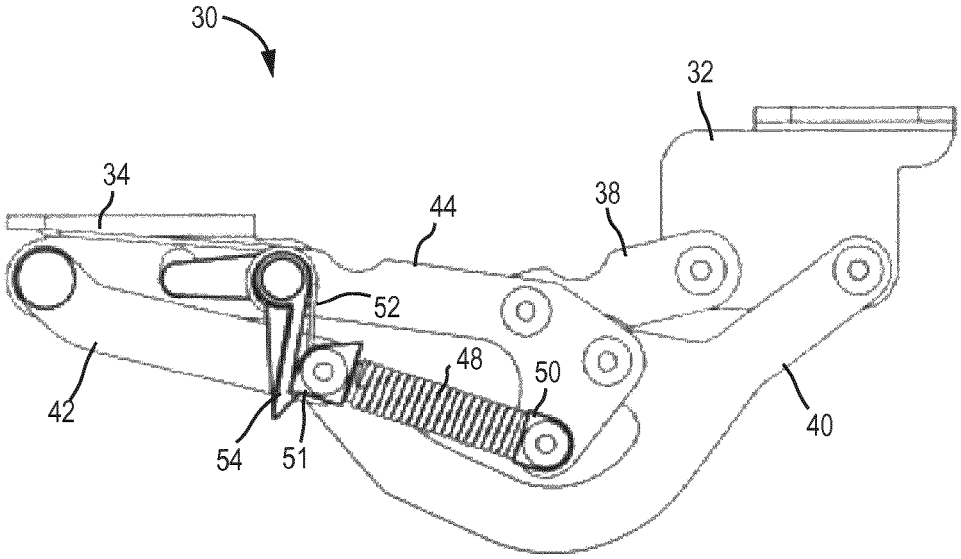
FIG. 5 is a side elevation view of the hinge in FIG. 2 in an second or open position according to a preferred an exemplary embodiment.

Referring to FIGS. 3-6, a hinge 30 for a refrigeration system is shown. Hinge 30 are provided on generally opposite ends of refrigerated appliance 10. Hinges 30 are coupled to the vertical legs of frame 16 and to panel 20 and allow panel 20 to be moved (e.g., pivoted, rotated, swiveled, etc.) relative to frame 16 from a first or closed position to a second or open position. Hinges 30 are generally similar members and according to an exemplary embodiment are mirror-images of each other. Accordingly, while only hinge 30 is shown in FIGS. 4-6 it should be understood that the other hinge 30 is generally similar. Hinge 30 includes a first mounting bracket 32, a second mounting bracket 34, and a linkage system 36 that couples first mounting bracket 32 to second mounting bracket 34. First mounting bracket 32 and second mounting bracket 34 are configured to be coupled to frame 16 and panel 20 respectively with bolts or any other suitable fastening method (e.g., rivets, welding, etc.). According to a preferred embodiment, the hinges are substantially or entirely concealed from a person standing in front of the refrigerated appliance and the panel is in the closed position.

Linkage system 36 is a kinematic system configured to allow panel 20 to be moved (guided) out and away from frame 16 with a translational/linear movement as well as a pivoting/rotating movement. Such articulation is intended to be done without having to disconnect panel 20 from frame or units 12, 14, and without having to disconnect fasteners or other couplings to otherwise separate panel from units 12, 14 or frame 16. Linkage system 36 includes a plurality of generally rigid links 38, 40, 42, 44, rivets 46, coil springs 48, spring mounts 50 and 51, a spring 52, and clips 54. Links 38, 40, 42, 44 (e.g., arms, bars, segments, etc.) are coupled to each other and to brackets 32, 34 with fasteners, shown as rivets 46 that allow links 38, 40, 42, 44 to rotate or pivot relative to each other and to the other components of hinge 30. First link 38 is coupled to first bracket 32. Second link 40 is coupled to first bracket 32 generally opposite of first link 38. Second link 40 also includes a protruding portion 41 that is coupled to fourth link 44. Third link 42 is coupled to second link 40 and second bracket 34. Fourth link 44 is coupled to first link 38 and second bracket 34 generally opposite of third link 42. While links 38, 40, 42, 44 are shown as being coupled to each other and to brackets 32, 34 generally at the ends, it should be understood that the according to other exemplary embodiments the links may extend past their pivot points. According to an exemplary embodiment, links 38, 40, 42, 44 and brackets 32, 34 are stainless steel.

Coil springs 48 are provided to bias hinge 30 towards an open position. Springs mounts 50 and 51 are nesting or telescoping members that receive springs 48 and are provided on either side of hinge 30. Spring mounts 50 and are coupled to a first portion 68 of linkage system 36 at a distal end of fourth link 44 and spring mounts 51 are coupled to a second portion 70 of linkage system 36 at the joint where second link 40 is coupled to third link 42. Spring mounts 50 and 51 have axial portions that are slidably engaged so that they can move relative to each other. According to an exemplary embodiment, one coil spring 48, one spring mount 50 and one spring mount 51 are couple to each side of hinge 30 with rivets 49. Coil springs 48 are held between spring mounts 50 and 51 are compressed when hinge 30 is moved from an open position to a closed position. According to an exemplary embodiment, spring mounts 50 and 51 are a polymer (e.g., nylon). According to other exemplary embodiments, spring mounts 50 and 51 may be another suitable polymer, stainless steel, or any other suitable material.

Hinge 30 further includes one or more latches 54 (e.g., clip, catch, hooks, etc.). Latch 54 is configured to engage one of spring mounts 51 when hinge 30 is in an open position to retain hinge (and panel 20) in an open position. Latch 54 is a generally L-shaped member with a first arm 55 that is coupled to second bracket 34, and a second arm 56 that includes an end 57 that engages spring mount 51. Latch 54 further includes a pivot point 58 between arms. According to an exemplary embodiment, a rivet 49 couples two latches 54 together on either side of second bracket 34.

To access the area above units 12, 14, a user grasps a bottom portion of panel 20 (e.g., at a recess or other area provided to direct the user's attention) and lifts. As the panel is lifted, linkage system 36 of hinges 30 articulate to move the entire panel 20 away from frame 16 (e.g., movement with a linear component) to provide clearance between panel 20 and appliance 10 and/or its adjacent environment. Linkage system 36 also articulates to move the lower portion of panel 20 up away from units 12, 14 (e.g., movement with pivoting/rotating components). At about the open (horizontal) position, latches 54 engages spring mounts 50, 51 to retain panel 20 in the desired position. To close panel 20, the user again grasps panel 20 and applies sufficient force to overcome resistance provided by the latch/mounts interface.

It is important to note that the terms "horizontal," "vertical," "and "top" are intended to be broad terms and not terms of limitation, and generally relate to orientations and areas of a refrigerator in an installed or use condition. These components may be used with any of a variety of products or arrangements and are not intended to be limited to use with refrigeration system applications. Also, "refrigerator" or "refrigeration" is used to describe a cooled space that may, but not necessarily, be below 32 degrees Fahrenheit or 0 degrees Celsius (a "freezer"). While the figures illustrate a system with a panel that rotates on a generally horizontal axis between a vertical orientation and a horizontal orientation it should be understood that the hinges may be uses in a wide variety of applications in a variety of different orientations and/or arrangements. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the refrigerator access panel hinge as shown in the preferred and other exemplary embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces (e.g. clamps, etc.) may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The closure apparatus may be sold separately as a kit or with a refrigerated appliance. It should be noted that the elements and/or assemblies of the system may be constructed from any of a wide variety of materials that provide sufficient strength or durability, in any of a wide variety of colors, textures and combinations. It should also be noted that the display system may be used in association with a rotating display, or alternatively other, fixed and non-movable displays or any of a wide variety of other surfaces in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A refrigerated appliance comprising:

a frame;

a panel hingedly coupled to the frame;

a first hinge coupling the panel to the frame and having a linkage system that guides movement of the panel between a closed position and an open position, the linkage system providing for both rotational and linear movement of the panel relative to the frame; and wherein the linkage system comprises:

a first mounting bracket coupled to the frame;

a second mounting bracket coupled to the panel; and a plurality of members directly or indirectly coupling the first mounting bracket and the second mounting bracket wherein the linkage system comprises a first link, a second link, a third link, and a fourth link; and wherein the first hinge further comprises a biasing apparatus configured to bias the panel toward the open position and comprising a first spring mount coupled to the fourth link and a second spring mount coupled to the second link and the third link, said first spring mount and said second spring mount are nesting or telescoping members that receive a spring in a compressed condition when the panel is in the closed position.

2. The refrigerated appliance of claim 1 wherein the first hinge further comprises a biasing apparatus coupled to the linkage system and configured to bias the panel toward the open position.

3. The refrigerated appliance of claim 2 wherein the first hinge further comprises a first biasing apparatus and a second biasing apparatus, the first biasing apparatus and the second biasing apparatus being disposed on opposite sides of the linkage system.

4. The refrigerated appliance of claim 2 wherein the biasing apparatus comprises a first spring mount coupled to a first portion of the linkage system and a second spring mount coupled to a second portion of the linkage system, and a spring located between the first spring mount and the second spring mount and in a compressed condition when the panel is in the closed position.

5. The refrigerated appliance of claim 1 further comprising a second hinge wherein the first hinge couples a first end of the panel to the frame and the second hinge couples a second end of the panel to the frame.

6. The refrigerated appliance of claim 1 further comprising a first refrigeration unit and a second refrigeration unit located adjacent to the first refrigeration unit, wherein the frame couples the first refrigeration unit and the second refrigeration unit and the panel extends between an outer lateral side of the first refrigeration unit and an outer lateral side of the second refrigeration unit.

7. The refrigerated appliance of claim 6 wherein the first refrigeration unit is a refrigerator or a freezer, and the second refrigeration unit is a refrigerator or a freezer.

8. The refrigerated appliance of claim 1 further comprising a latch coupled to the linkage system and configured to retain the panel in the open position.

9. A refrigerated appliance comprising:

at least a first refrigeration unit distinct from a second refrigeration unit;

a frame configured to couple the first refrigeration unit to the second refrigeration unit;

a panel configured to extend substantially from an outer lateral side of the first refrigeration unit to an outer lateral side of the second refrigeration unit;

a closure mechanism comprising:

a pair of hinges configured to couple the panel to the frame, each hinge having a linkage;

wherein the linkage provides for lateral and rotational movement of the panel between a closed position and an open position wherein the one or more biasing apparatuses comprise a first spring mount coupled to a first portion of the linkage and a second spring mount coupled to a second portion of the linkage and the first spring mount, and a spring received by the first spring mount and the second spring mount and in a compressed condition when the panel is in the closed position; and wherein each hinge comprises a latch coupled to the linkage and configured to engage one of the spring mounts to retain the panel in the open position when engaged.

10. The refrigerated appliance of claim 9 wherein the linkage is a multi-bar linkage.

11. The refrigerated appliance of claim 10 wherein each multi-bar linkage is a six-bar linkage.

12. The refrigerated appliance of claim 9 wherein each hinge comprises one or more biasing apparatuses configured to bias the panel toward the open position.

13. The refrigerated appliance of claim 9 wherein the open position is configured to provide visible or physical access to one or more refrigeration components associated with the first refrigeration unit and/or the second refrigeration unit.

14. The refrigerated appliance of claim 9 wherein the panel comprises at least one of a decorative panel or a grill with a plurality of slats.

* * * * *